US007143531B2

(12) United States Patent
Micozzi

(10) Patent No.: US 7,143,531 B2
(45) Date of Patent: Dec. 5, 2006

(54) PLOW PROTECTOR

(76) Inventor: Albert M. Micozzi, 39 Danny Rd., Hyde Park, MA (US) 02136

( * ) Notice: Subject to any disclaimer, the term of this patent is extended or adjusted under 35 U.S.C. 154(b) by 0 days.

(21) Appl. No.: 10/884,233

(22) Filed: Jul. 2, 2004

(65) Prior Publication Data

US 2006/0000122 A1 Jan. 5, 2006

(51) Int. Cl.
*E01H 5/04* (2006.01)

(52) U.S. Cl. ..... 37/232

(58) Field of Classification Search ..... 37/232, 37/233, 235, 264, 266; 172/811, 817, 260.5, 172/261, 266, 267
See application file for complete search history.

(56) References Cited

U.S. PATENT DOCUMENTS

| | | | | | |
|---|---|---|---|---|---|
| 3,456,369 | A | * | 7/1969 | Leposky | 37/232 |
| 3,587,182 | A | * | 6/1971 | Hirt | 37/232 |
| 3,587,751 | A | * | 6/1971 | Schmidt | 172/264 |
| 3,775,877 | A | * | 12/1973 | Gove, Sr. | 37/233 |
| 3,831,689 | A | * | 8/1974 | Smith | 180/313 |
| 3,995,698 | A | | 12/1976 | Nelson et al. | |
| 4,259,794 | A | * | 4/1981 | Rath | 37/233 |
| 4,307,523 | A | * | 12/1981 | Reissinger et al. | 37/233 |
| 4,346,528 | A | | 8/1982 | Shwayder | |
| 4,794,710 | A | * | 1/1989 | Haring | 37/232 |
| 4,799,823 | A | | 1/1989 | Williams | |
| 4,833,801 | A | | 5/1989 | Winter | |
| 5,109,618 | A | * | 5/1992 | Grubler et al. | 37/232 |
| 5,323,862 | A | | 6/1994 | Furlough | |
| 5,437,113 | A | | 8/1995 | Jones | |
| 5,697,172 | A | | 12/1997 | Verseef | |
| 5,829,174 | A | | 11/1998 | Hadler et al. | |
| 5,921,010 | A | * | 7/1999 | Schulte et al. | 37/232 |
| 5,987,785 | A | | 11/1999 | Aguado et al. | |
| 6,125,559 | A | | 10/2000 | Mullenhour | |
| 6,219,943 | B1 | | 4/2001 | Kitchell | |
| 6,408,548 | B1 | * | 6/2002 | Altheide | 37/268 |
| 6,618,965 | B1 | | 9/2003 | Schultz et al. | |
| 6,701,646 | B1 | | 3/2004 | Schultz et al. | |
| 2004/0006895 | A1 | | 1/2004 | Schultz et al. | |

FOREIGN PATENT DOCUMENTS

| | | | |
|---|---|---|---|
| JP | 2001103801 | A | 4/2001 |
| JP | 2002322626 | A | 11/2002 |
| JP | 2003278118 | A | 10/2003 |

* cited by examiner

OTHER PUBLICATIONS

S-Cam Brake Adjustment and Fuel Economy?, http://www.leeric.lsu.edu/bgbb/7/ecep/diesel/d/d.htm.

*Primary Examiner*—Victor Batson
(74) *Attorney, Agent, or Firm*—Robert Plotkin, P.C.

(57) ABSTRACT

In one aspect of the present invention, a plow protection device is disclosed. Such a device may, for example, protect a plow against substantial damage from impact with an obstruction such as a utility cover. In various embodiments of the present invention, the plow protection device multiplies velocity, distance, and kinetic energy at the point of impact between the plow and the obstruction to lift the plow's cutting edge up and away from the obstruction and the road or other plowing surface. By actively lifting the cutting edge over the impacted obstruction, embodiments of the present invention thereby limit the duration and severity of impact and minimize the resulting stresses. In another aspect of the present invention, a wear protector is provided to protect one or more components of the present invention and/or plow from wear due to friction with the plowing surface.

48 Claims, 15 Drawing Sheets

PLOW PROTECTOR

BACKGROUND

1. Field of the Invention

The present invention relates to plows, snow removal equipment and, more particularly, to devices for protecting plows and snow removal equipment against damage from impact with road obstructions.

2. Related Art

Modern snow removal devices, such as vehicle-mounted snow throwers and snowplows, typically are mounted to the front and rear ends of light, medium, and heavy-duty trucks, front end loaders, back hoes, tractors, graders, and similar vehicles. Snowplow blades typically include a curved moldboard which is mounted on a frame. Snow throwers and plows alike have a wear-strip, often made of steel, which may be mounted to the bottom of the frame to act as a scraping blade to remove snow from the ground and to direct the snow onto the moldboard. This action of both types of snow removal equipment will be referred to herein as "plowing."

Roads and other plowing surfaces may include a variety of irregularities and obstructions, such as raised manhole covers, rocks, raised or cracked road sections and debris which has become frozen into the ground. Such obstacles may lie partially or completely beneath the surface of the snow and therefore be hidden from the plow operator's view. There is always a risk that the plow blade edge or other portion of the plow will strike such an obstruction while plowing. In addition to such unforeseen obstructions, known road features (such as curbs and berms) may be hidden from the plow operator by the snow. There is always a risk, therefore, that the plow operator will miscalculate the distance to such a known road feature and fail to stop the plow before it impacts the hidden road feature.

The plow blade may strike the obstruction with significant force, which is then transferred rearward from the plow blade to the plow assembly, the attached vehicle, and the vehicle operator. Such impacts may be significant not only at faster plowing speeds of 25–30 mph, but even at slower speeds of 10–15 mph. The force of such an impact may not only cause a sudden deceleration of the plow and attached vehicle, but may also cause the plow to violently and completely stop the vehicle. In some cases the plow may deflect off the obstruction and jump into the air. In some other cases the bolts holding the cutting edge have been known to shear, causing the cutting edge to flip through the air, thereby becoming a dangerous projectile and road hazard. This response to hitting an obstruction may not only cause significant damage to the plow and truck, but also cause personal injury to the plow operator and other nearby vehicles. Although driving at slower speeds may decrease the damage caused by such impacts, slower speeds decrease plowing efficiency. Furthermore, driving at slower speeds still does not completely eliminate impacts because, as described above, obstructions may be completely hidden from view and therefore be unavoidable even to the most careful of operators.

As a result of these problems, various efforts have been made to design plows to minimize the undesirable consequences just described. For example, many existing snow plow blades are equipped with a blade trip mechanism, also referred to as a "trip edge" or "trip assembly," which allows the bottom of the plow blade to yield ("trip") upon substantial impact. Conventional trip edges are described, for example, in U.S. Pat. No. 6,618,965, entitled "Cushion Stop and Method for Absorbing Bidirectional Impact of Snow Plow Blade Tripping." In general, the plow blade is enabled to trip upon impact by mounting the snow plow blade on its support structure using a pivoting mechanism. The plow blade may, for example, be mounted on the support structure at a height of 8–16 inches above the ground. The pivoting mechanism enables the bottom of the snow plow blade to pivot in a rearward direction when the blade impacts an obstruction. The top of the snow plow blade pivots forward as the bottom of the snow plow blade pivots rearward in response to the force imposed by the obstruction. This rearward pivoting of the bottom of the snow plow blade in response to impacting an obstruction is referred to as "tripping."

Typically, one or more strong springs (referred to as "trip springs") are mounted behind the snow plow blade to resist tripping the blade edge except in response to a sufficiently strong rearward force. When the snow plow blade is in its normal (untripped) position, the trip springs are under tension, holding the blade edge in place. When the bottom of the snow plow blade is forced backward by an obstruction, the trip springs provide a resistive force which tends to absorb at least some of the force of impact with the obstruction. The force of such an impact may be reduced by this energy absorption, but still will impose some deceleration of the plow and attached vehicle. It may also cause the plow to violently lift into the air, sometimes by two feet or more, and then rapidly fall, impacting the ground. When the tripping force imposed by the obstruction is removed, the trip springs provide a restorative force which returns the snow plow blade to its normal (untripped) plowing position.

In the absence of trip springs, or if the biasing force provided by the trip springs is not sufficiently strong, the blade edge might trip too easily, such as upon contacting wet snow. As a result, trip springs typically are chosen to be quite strong. The restorative force, therefore, provided by the trip springs upon removal of the obstructive force also tends to be quite strong. The trip springs may, therefore, cause the snow plow blade to return to its normal plowing position with significant force, thereby causing a significant impact between the plow blade and its supporting structure. In the case where the plow is violently lifted into the air and the plow assembly drops to the plowing surface with all its weight, this impact may result in damage to the snow plow blade, its supporting structure, the plow's many components and/or to the vehicle. This represents one disadvantage of plow protection mechanisms which rely solely on trip edges.

Another problem faced by plow operators is that regions of the plow, such as the blade edge, that are in contact with the plowing surface are subject to significant wear due to friction and other forces, particularly when plowing is performed on asphalt or other hard road surfaces. In the case of the plow blade, such wear decreases plowing efficiency over time. In general, a plow cutting edge may typically be replaced one or two times each plowing season, and a set of wear pads may be replaced as frequently as once per snow storm. Both of these components may be replaced more frequently depending on the amount of plowing that is performed and plowing and road conditions. More generally, all components that are subject to wear require periodic replacement due to such wear. It is desirable, therefore, to take steps to reduce or minimize the impact of wear, and thereby to increase the useful life of components, thereby decreasing plow downtime and component replacement frequency, and in turn increasing plowing efficiency and decreasing the overall cost of maintenance.

One technique that has been employed to decrease wear is to provide wheels and/or wear guards which are attached to the moldboard, behind the plow blade edge, to support part of the load on the blade, thereby prolonging the time until the blade must be replaced. Even such protective devices, however, eventually wear out and are damaged, requiring replacement. Therefore, it is desirable to increase the life of protective devices such as wear guards, thereby decreasing the total cost of maintenance.

SUMMARY

In one aspect of the present invention, a device is provided for use with a snow removal apparatus, such as a plow. The device includes lifting means for lifting at least part of the snow removal apparatus away from the snow removal surface and over an impacted obstacle by pressing down on a snow removal surface; and lift activation means, coupled to the lifting means, for activating the lifting means in response to an impact of a component of the snow removal apparatus with the obstacle.

In another aspect of the present invention, a machine-implemented method is provided use with a snow removal apparatus, such as a snow plow, including a protection device. The method includes steps of: (A) receiving force generated by an impact of a component of the snow removal apparatus with an obstacle; and (B) lifting at least part of the snow removal apparatus away from a snow removal surface in response to receipt of the force.

In yet another embodiment of the present invention, a device is provided for use with a snow removal apparatus having a cutting edge. The device includes a wear guard coupled to a component of the snow removal apparatus other than the cutting edge, the wear guard comprising means for protecting the component other than the cutting edge.

Other features and advantages of various aspects and embodiments of the present invention will become apparent from the following description and from the claims.

DETAILED DESCRIPTION

Figure 1A:
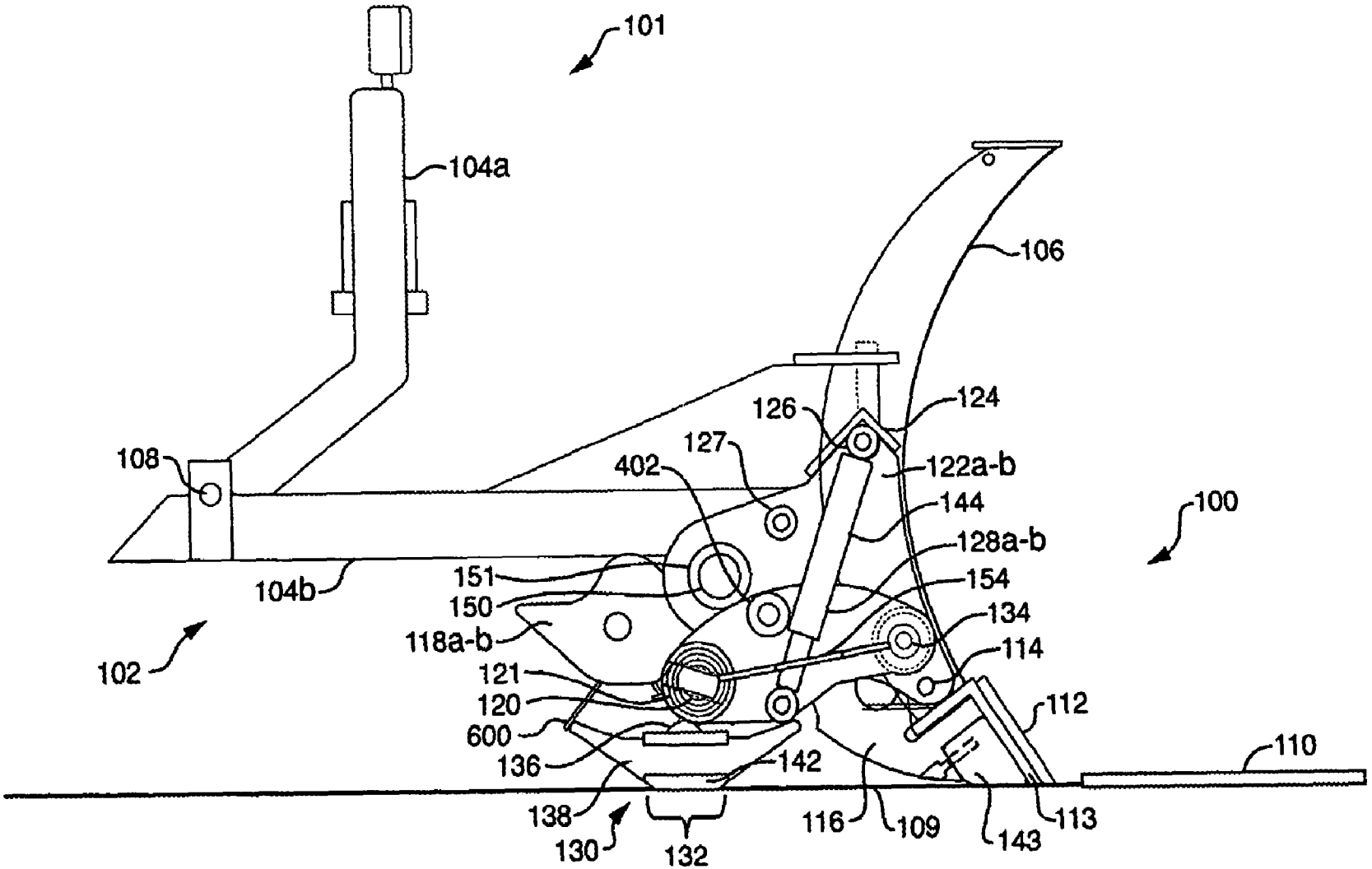
FIG. 1A is a side view of a plow protection device according to a first embodiment of the present invention.

In one aspect of the present invention, a plow protection device is disclosed. Such a device may, for example, protect a vehicle-mounted snow thrower or plow, equipped with a trip device or any suitable energy absorption or energy transference device, against damage from impact with an obstruction. Such obstructions may include, for example, a manhole cover, embedded rock, metal, utility cover, sections of frozen ground, and lifted or cracked asphalt or cement. In various embodiments of the present invention, the plow protection device multiplies velocity, distance, and kinetic energy at the point of impact between the plow and the obstruction to lift the plow's cutting edge away from the road or other plowing surface and over the impacted obstruction.

The distance-multiplying feature of the plow protection device enables the rate of lift created to be greater than the rate at which the plow travels laterally over the plowing surface. As described in more detail below, in one embodiment of the present invention, the lift to distance ratio is approximately 3:1. As a result, the plow blade edge can be lifted over the impacted obstruction more quickly and reliably than in prior art approaches, in which the plow blade edge stays in contact with and rolls over the obstruction. Embodiments of the present invention thereby enable the plow blade to continue moving forward past the obstruction without an appreciable adverse reaction and/or interruption in snow removal or other plowing activity.

As described above, in systems which rely solely on trip edges or trip assemblies for plow protection, the plow blade edge may reach its maximum trip position before passing over the impacted obstruction, thereby potentially causing the trip springs to become overloaded or charged with a large potential energy force. The resulting sudden deceleration may cause significant forces to be transmitted through the plow edge to the plow assembly and to the attached vehicle, causing damage in the manner described above. In contrast, the ability of embodiments of the plow protection device, disclosed herein, to lift the plow blade edge over the obstruction, without delay and at a higher rate of speed than the forward travel of the vehicle, rather than merely to rotate the plow blade edge backward at the point of impact, enables the plow to continue moving past the obstruction much earlier, thus significantly limiting the accumulating stresses to the plow assembly and/or attached vehicle. As a result, embodiments of the plow protection device disclosed herein will both reduce interruptions in plowing and decrease damage to the plow and connected vehicle, thereby increasing the lifetime and decreasing the maintenance costs of both plow and vehicle.

The plow protection device may be implemented in any of a variety of ways. For example, the device may utilize a lifting mechanism including any combination of force transference members (such as levers, cams, wedges, gears, bearings, plates, or dogs) to lift the cutting edge and plow assembly over and away from an impacted ground obstruction at an accelerated velocity without any appreciable delay. The force transference members may, for example, be coupled using direct mechanical connections to enable the device to transfer plow weight substantially and instantaneously from the cutting edge and/or skid plates to a separate lifting component rear of the cutting edge. Due to the speed at which the plow cutting edge may be forced backwards by an obstruction, the near-instantaneous transference of force provided by direct mechanical connections provides an advantage over other force-absorption mechanisms. Such other mechanisms introduce delays and prolong contact with the obstruction, allowing forces to build, and resulting in more frequent and more serious potential damage.

The separate lifting component provided in embodiments of the present invention may be implemented in any of a variety of ways. The lifting component may, for example, be a plate, roller, wheel, caster, or any other component or combination of components for supporting the plow's weight after impact. The force transference members may be arranged so as to multiply the forward velocity of the plow and impacted cutting edge while converting the multiplied velocity and force to a lifting action at the point of contact between the rearward lifting component and the plowing surface. In particular, the multiplied velocity and force are applied by the lifting component directly to the ground or other plowing surface at a point to the rear of the cutting edge. The location of the lifting component thereby shifts the plow's ground contact point and weight in relation to the plow's mounting fulcrum point. This new position again multiplies the distance by which the plow and cutting edge are lifted off the ground and above the impacted obstacle. In doing so, the plow protection device may limit: (1) the time the cutting edge is in contact with an impacted ground obstacle; (2) the severity of impact to the plow and truck components; (3) the travel of any energy absorption devices and the unnecessary potential energy stored thereby; and (4) the sudden release of the potential energy during the return cycle and its resulting violent action and shock as the plow impacts the ground.

In comparison to conventional energy absorption devices (such as tripping plow blades and trip edges), embodiments of the plow protection device disclosed herein enable the plow and attached vehicle to be subjected to only a fraction of the total potential force or potential bottoming forces. Because the plow will be subject to significantly less trauma, embodiments of the present invention may enable both plows and vehicles to last longer before requiring replacement. Furthermore, embodiments of the present invention may enable some plows to be engineered for less weight and/or cost to manufacture, due to the decreased need to use expensive and more impact-resistant components, costly manufacturing methods, and structural steels. For at least these reasons, embodiments of the present invention may advantageously be used to reduce operator injury, damage to the plow, vehicle, and road, and the total cost of plowing operations.

Embodiments of the plow protection device disclosed herein may be configured by the operator to begin lifting immediately upon impact of the plow blade edge with an obstacle. Alternatively, the device may be configured to begin lifting only after the tripping plow or tripping cutting edge has traveled a preset minimum distance.

The device may be equipped with a locking mechanism to remotely inhibit the lifting mechanism from activating. Such a locking mechanism may, for example, be advantageous for use in conjunction with low-speed frozen snow and ice removal. The locking mechanism may, for example, include a locking shear pin and bushing. Such a locking mechanism may, for example, be activated remotely with a momentary switch wired to operate a miniature hydraulic cylinder set to push the pins through two components and thus prohibit its movement. The locking/shear pin may be a replaceable item used to shear and release the mechanism upon low speed over load conditions.

The lifting mechanism may include a wear protector that is constructed of a relatively wear-proof material such as die steel containing molybdenum (Mo) and/or tungsten. The use of molybdenum allows for an optimal combination of maximum hardness (wear resistance) and toughness (less brittleness), and with less potential to fracture than other materials. The plow may also include a lift lever wear protector, mounted behind the bottom edge of the plow blade, which may be constructed from the same or similar material as the lift plate wear protector. Such wear protectors may be located to be in contact with the plowing surface (e.g., road) as the cutting edge wears down during normal operation and thereby to be subject to the majority of friction generated between the plow and the plowing surface. Construction of such wear protectors from relatively wear-proof materials may advantageously increase the life of components of the plow and the plow protection device, and thereby to decrease total plowing costs. Furthermore, the wear protectors may be implemented as removable components which may be replaced individually once they have been worn down to a sufficient degree, thereby eliminating the need to replace the plow protection device, the plow's cutting edge, the trip edge or even the entire plow blade, further reducing maintenance costs.

Another advantage of embodiments of the plow protection device disclosed herein is that they are suitable for use with steel-edge plow blades. Plow protection mechanisms that are based solely on trip devices may tend to use rubber plow blades as a partial force-absorption mechanism. Although rubber blades can absorb some impact, rubber blades are susceptible to being gouged. Furthermore, rubber blades tend to be more than double the cost of steel blades and are inferior to steel blades in terms of their plowing efficiency. As a result, rubber blades provide a tradeoff between impact absorption and plowing efficiency. Furthermore, as the road surface starts to freeze, rubber cutting edges tend to ride up on the freezing slush, leaving the road covered with a dangerously slippery surface. The use of rubber blades requires increased use of sand and salt products on the road to break down the additional freezing slush and packed snow that is left behind. In addition to being costly, road salt is a water supply contaminant. By further enabling the use of steel blades, the techniques disclosed herein enable increased plowing quality and efficiency, and decreased use of sand and salt.

Referring to FIG. 1A, a side view of a plow protection device 100 according to one embodiment of the present invention is shown. The plow protection device 100 is coupled to a conventional plow 101 having a plow mold board assembly 106, which in turn is coupled to a plow frame 102 having upper member 104*a* and lower member 104*b*. Upper member 104*a* and lower member 104*b* are hinged/coupled by a mounting pin 108 defining a fulcrum point. Plow frame 102 may be attached to a truck or other vehicle (not shown), as is well-known to those having ordinary skill in the art.

The particular mold board assembly 106 shown in FIG. 1A is similar to a Fisher® HD series snow plow. The plow 101 travels laterally over a plowing surface 109, such as an asphalt road. In the example illustrated in FIG. 1A, the plowing surface 109 includes a ground obstacle 110, such as a raised manhole cover. The plow 101 includes a trip edge 113 with cutting edge 112 mounted to the fixed mold board assembly 106 by a pin 114.

When the tip of plow's cutting edge 112 comes into contact with the ground obstacle 110, the trip edge 113 and cutting edge 112 rotates on pin 114 and the tip moves linearly and toward the rear of the plow 101 (i.e., to the left in FIG. 1A). This movement is parallel to the plowing surface 109, at the same rate of speed at which the attached vehicle (not shown) and plow 101 are moving forward. For example, referring to FIG. 1C, a side view is shown of the plow protection device 100 before impact of the trip cutting edge 112 with the ground obstacle 110, at which time the cutting edge 112 is in contact with the plowing surface 109.

Figure 1B:
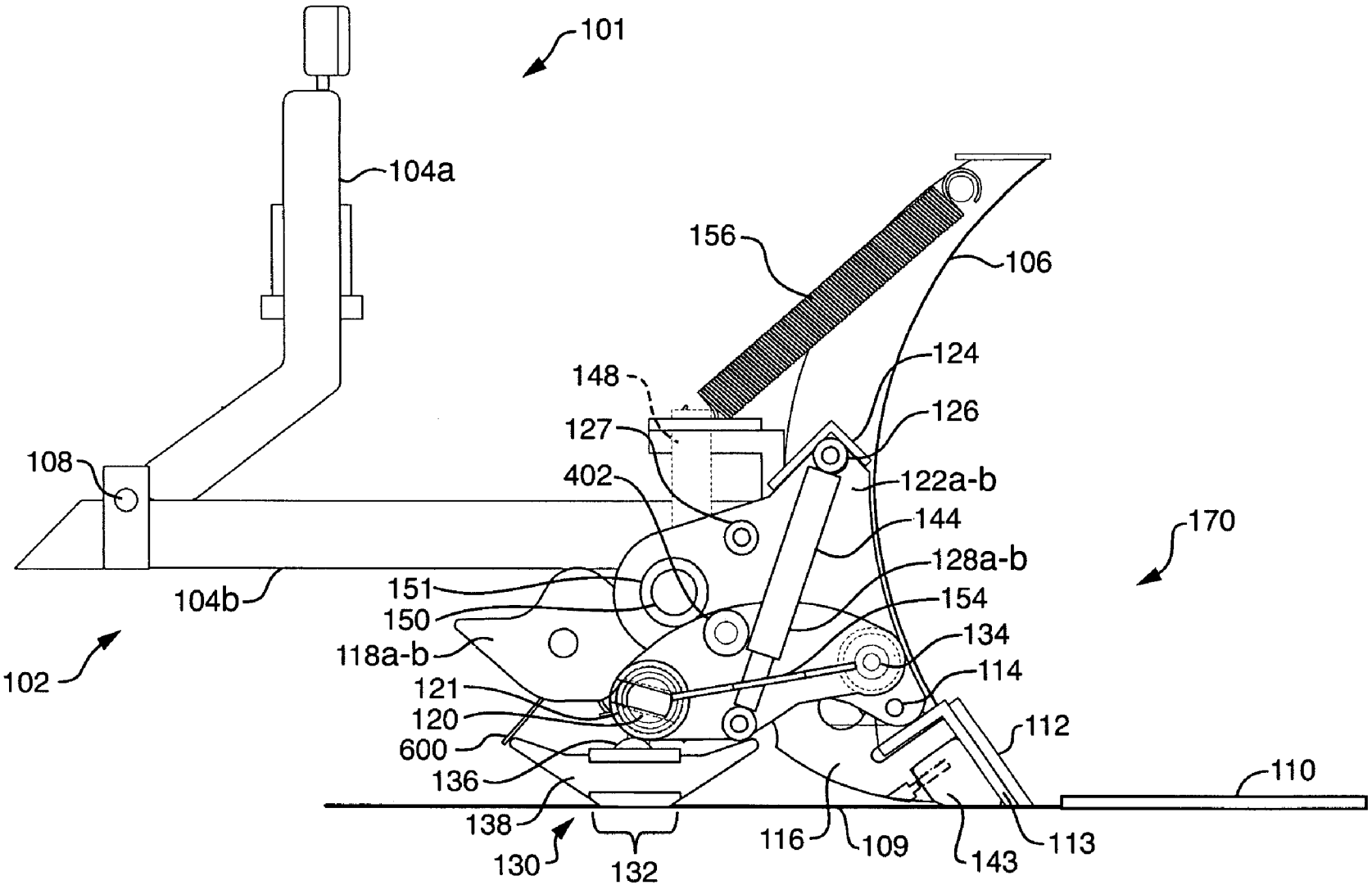
FIG. 1B is a side view of a plow protection device according to a second embodiment of the present invention.
Figure 1C:
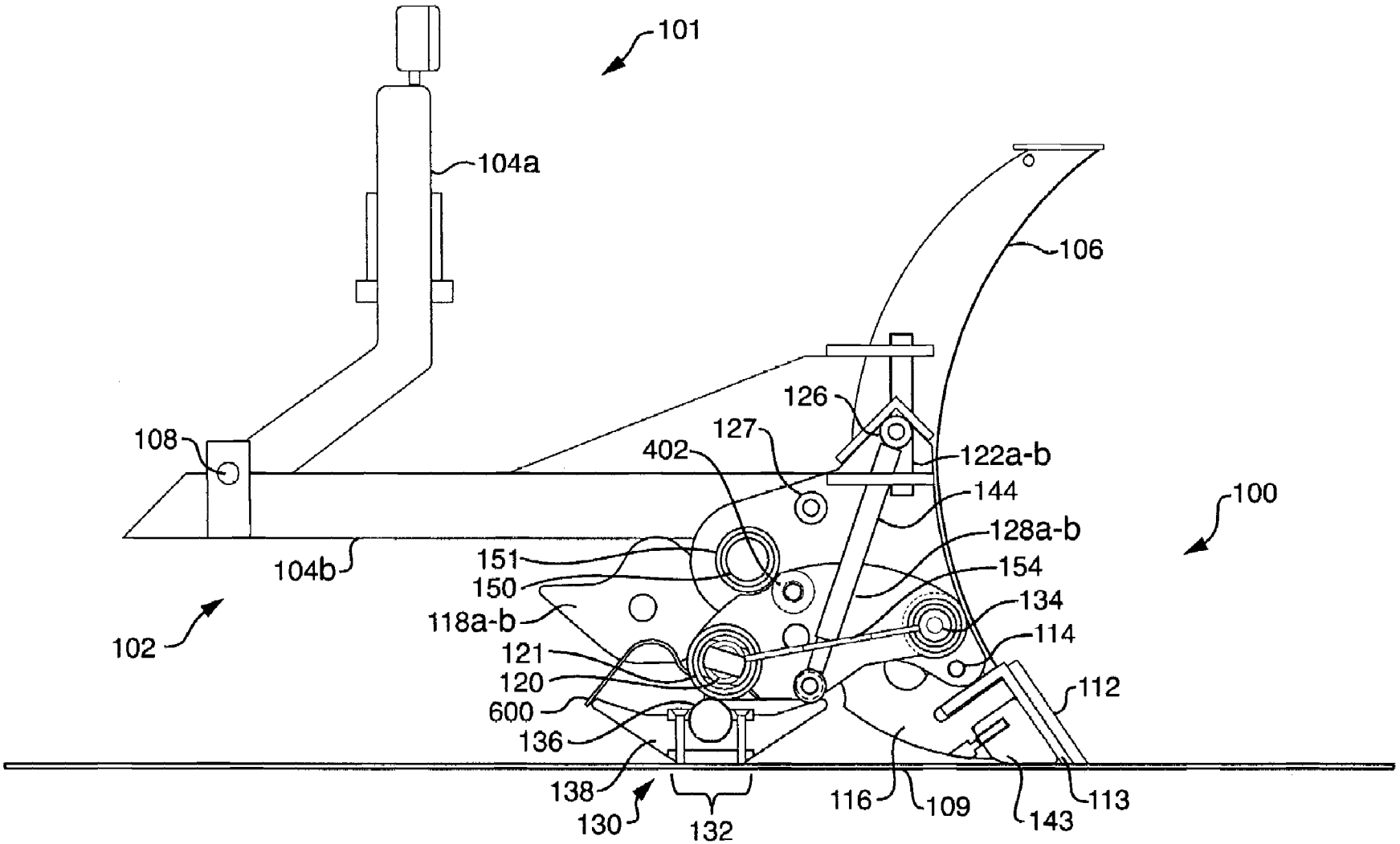
FIGS. 1C–1G are side views of the plow protection device of FIG. 1A in various stages of operation in response to impact of the plow cutting edge with an obstacle.
Figure 1D:
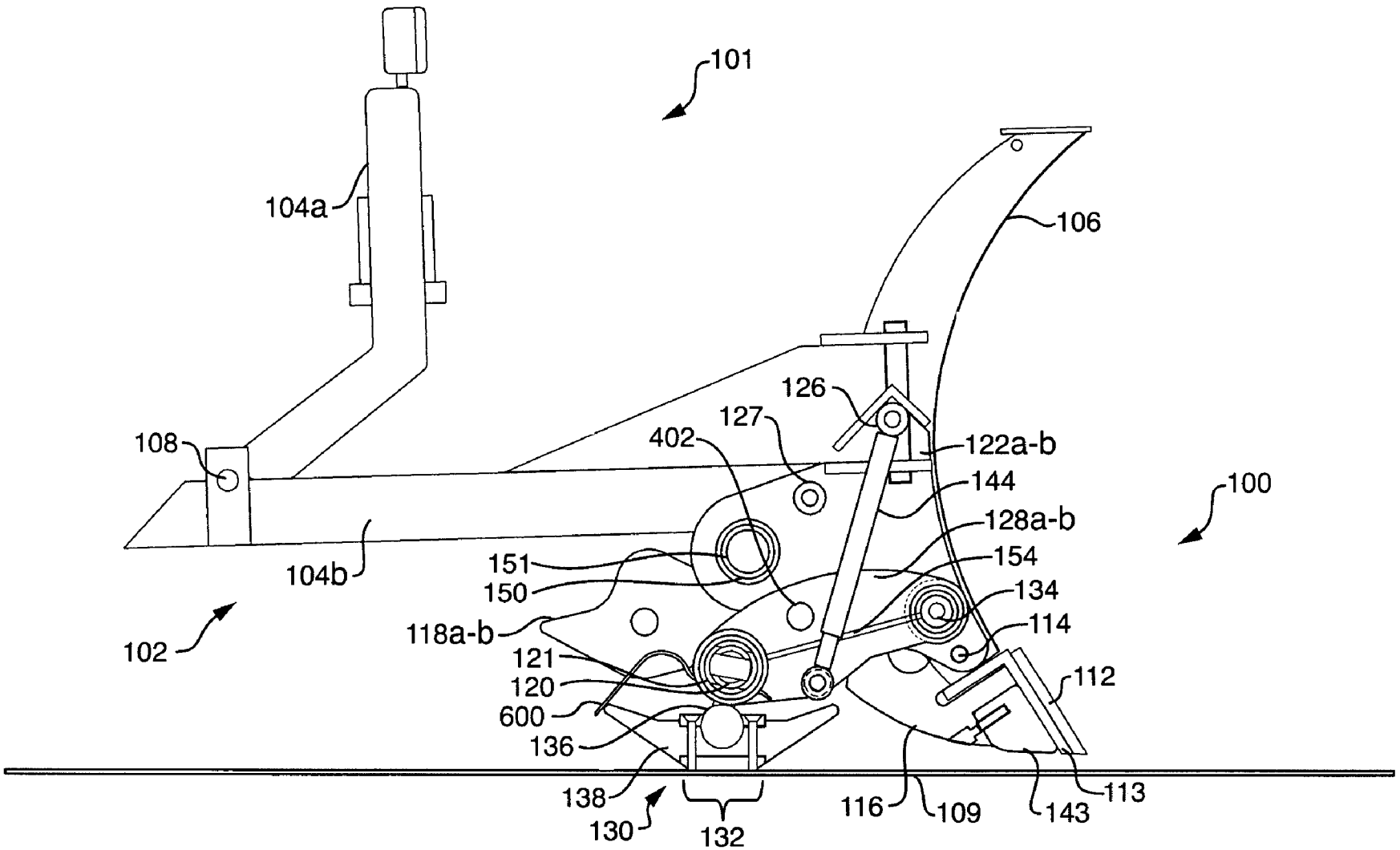

Referring to FIG. 1D, a side view is shown of the plow protection device 100 after impact of the trip edge 113 and cutting edge 112 with the ground obstacle 110, and after the cutting edge 112 has moved 0.25 inches laterally. In response to such impact and lateral movement, the plow protection device 100 lifts the cutting edge 112 over ground level by approximately 0.5–0.75 inches, with the exact amount to vary depending on the plow weight and truck suspension. Even this relatively small amount of lift will clear a wide variety of paved street obstacles, such as most raised utility covers. Note that in the embodiment shown in FIGS. 1A and 1C–1G, the moldboard 106 does not pivot.

Figure 1E:
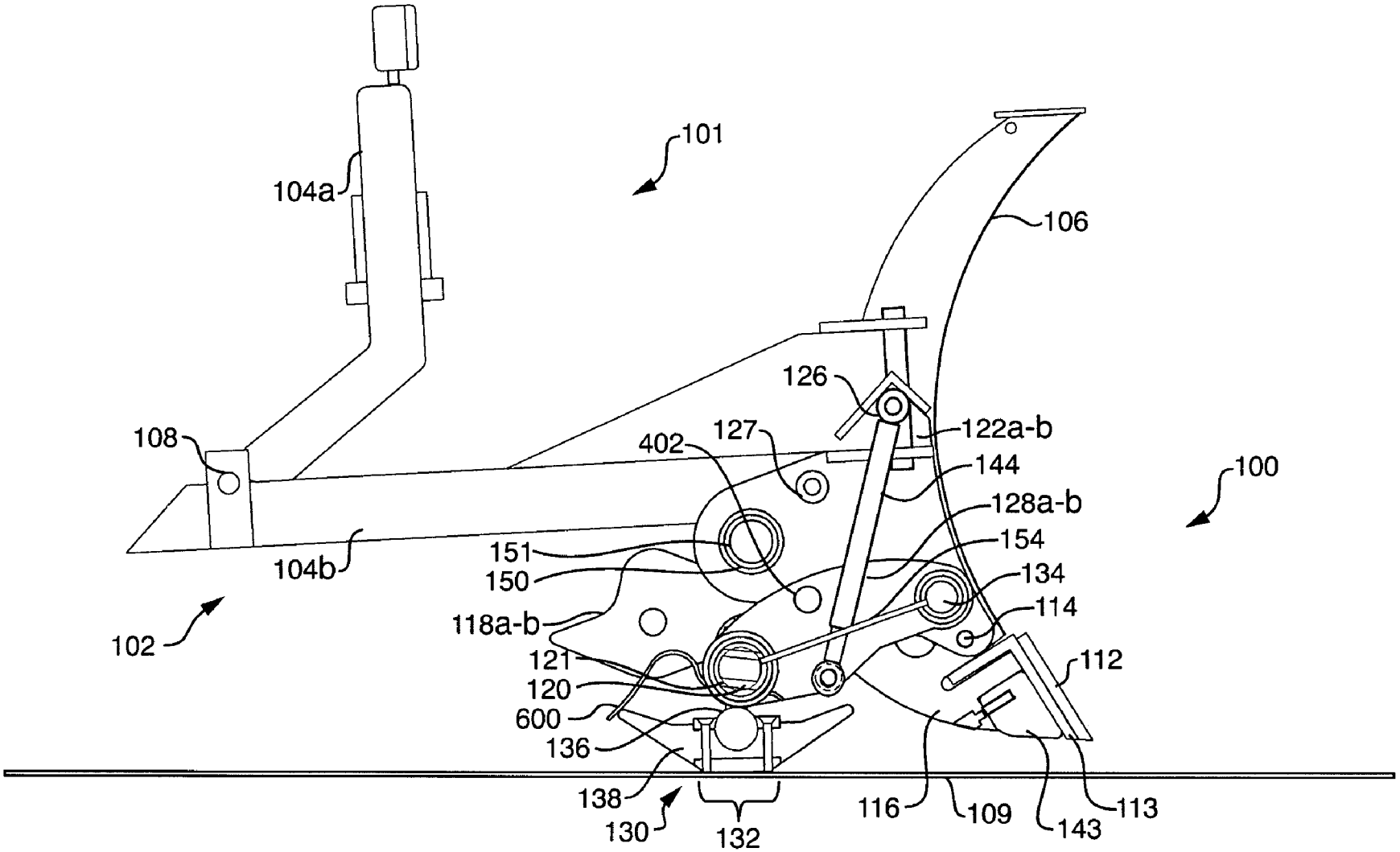
Figure 1F:
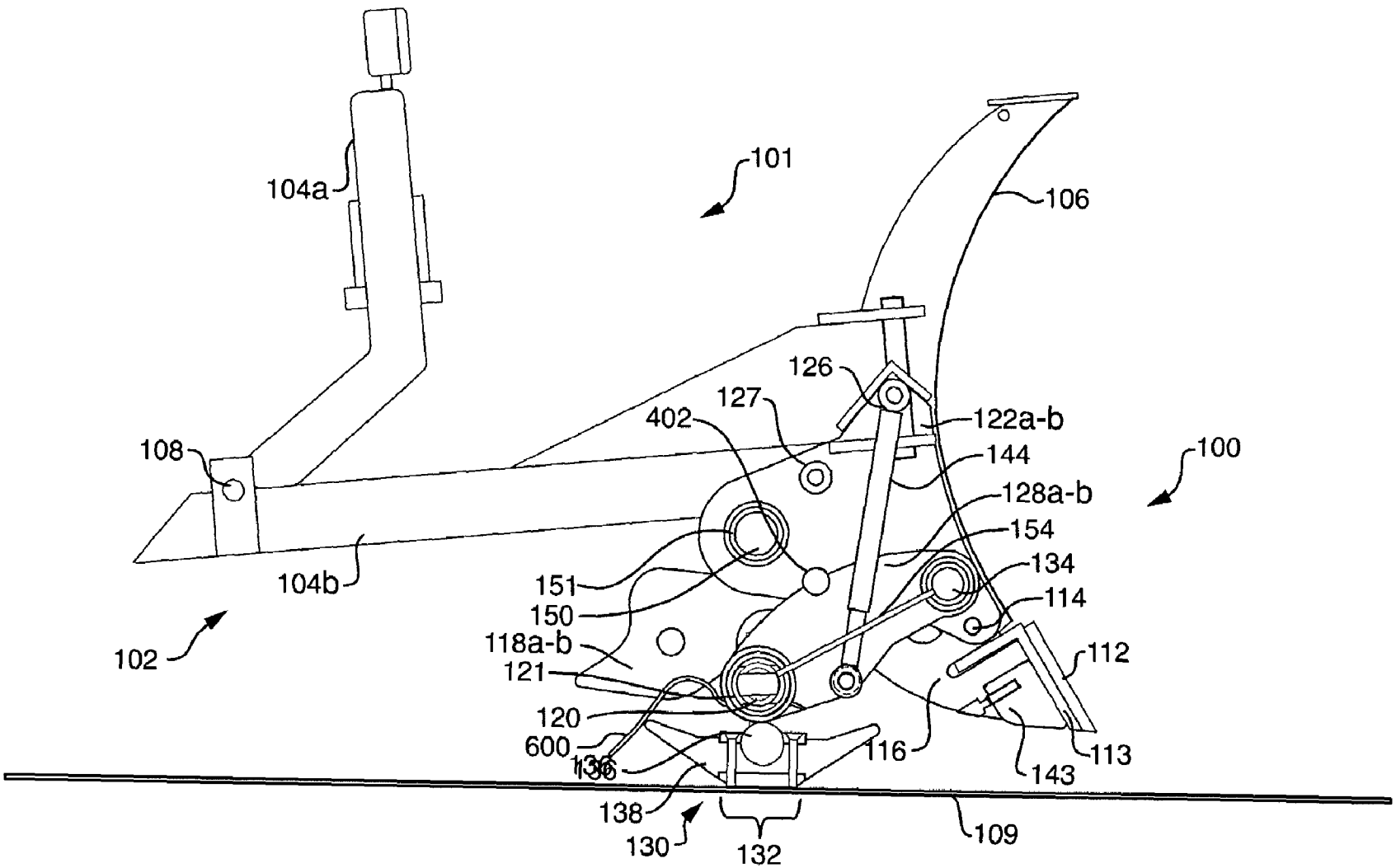
Figure 1G:
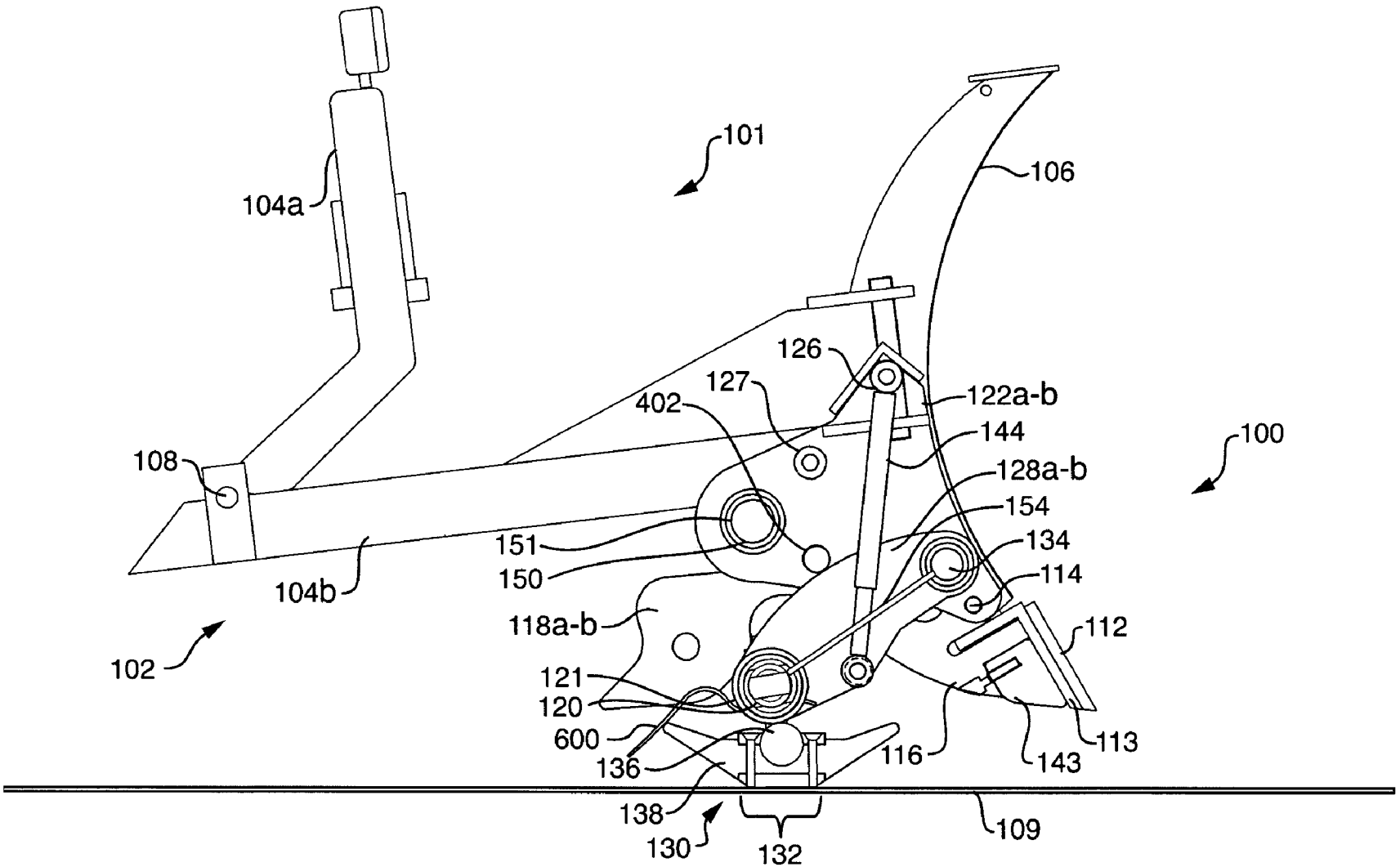

Referring to FIG. 1E, a side view is shown of the plow protection device 100 after the plow cutting edge 112 has moved laterally by a total distance of 0.5 inches. In response to such movement, the plow protection device 100 has lifted the cutting edge 112 over ground level by approximately 1.125–1.5 inches. Referring to FIG. 1F, a side view is shown of the plow protection device 100 after the plow cutting edge 112 has moved laterally by a total distance of 0.75 inches. In response to such movement, the plow protection device 100 has lifted the cutting edge 112 over ground level by approximately 2.25–3.0 inches, enough to enable the cutting edge 112 to clear the vast majority of paved street obstacles. Finally, referring to FIG. 1G, a side view is shown of the plow protection device 100 after the plow cutting edge 112 has moved laterally by a total distance of 1.0 inches. In response to such movement, the plow protection device 100 has lifted the cutting edge 112 over ground level by more than 3.0 inches.

Figure 2A:
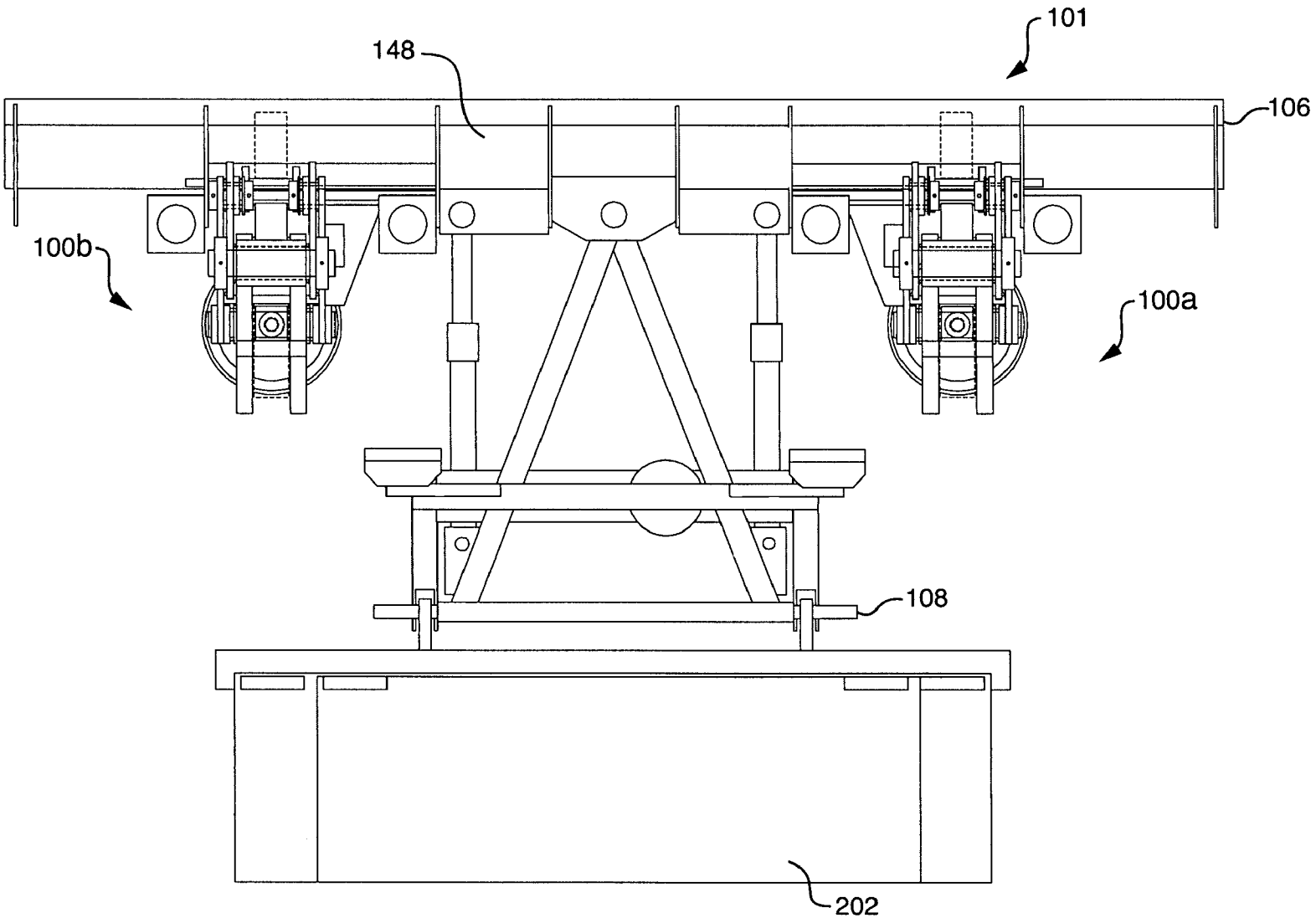
FIGS. 2A–2B are top views of the plow protection device of FIG. 1A.
Figure 2B:
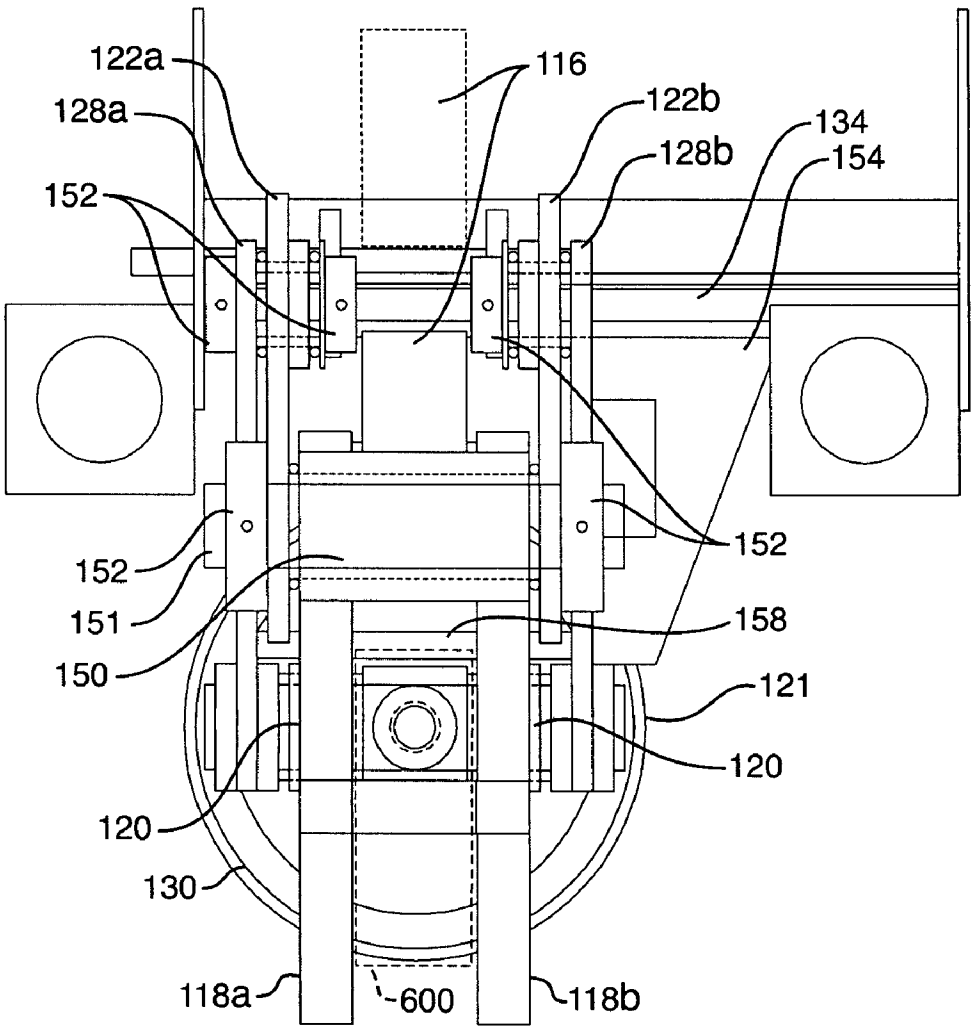

Referring to FIGS. 2A–2B, a top view is shown of a plow including the plow protection device 100 shown in FIGS. 1A–1G. The hood 202 of a truck to which the plow 101 is mounted is shown for ease of reference. As can be seen in the top view of FIG. 2A, the plow protection device 100 includes plow protection device assemblies 100*a* and 100*b* on either side of the plow 101. Therefore, it should be appreciated that certain components described singularly in the description of FIGS. 1A–1G, such as the lift plate assembly 130, lift wedge 118, and control arm 128, actually appear in each of the plow protection device assemblies 100*a–b*. Furthermore, certain components which are hidden from view in FIGS. 1A–1G may be seen in FIGS. 2A–2B, as will be made clear in the following description.

The manner in which the plow protection device 100 causes the above-described lift of the plow cutting edge 112 in response to impact with the obstacle 110 will now be described in more detail. Although the following description refers to the operation of one of the plow protection device assemblies 100*a*, it should be appreciated that the same description applies equally to the other assembly 100*b*.

Rearward movement of the trip edge 113 and cutting edge 112 and/or trip assembly causes a lift lever 116 to rotate on the pivot point 114. This rotation of the lift lever 116 pulls forward and upward on lift wedges 118*a–b*. In response, the top and bottom surfaces of the lift wedges 118*a–b* ride bearings 150 (in shaft 151) between right and left pressure plates 122*a–b* and the bearings 120 in the control arm rear shaft 121.

The pressure plates 122*a–b* are fixed to the plow's moldboard 106 by a welded pressure plate mounting angle 124 and welded pressure plate spacer and bolt/strut rod 126. The resulting action of the lift lever 116 and lift wedges 118*a–b* drives control arms 128*a–b* and lift plate assembly 130 away from the fixed pressure plates 122*a–b* and into the plowing surface 109 at the region of contact 132 between the lift plate assembly 130 and the plowing surface 109, thereby lifting the plow assembly 100*a* at a rate of approximately 2 to 1. In other words, the control arms 128*a–b*, the rear control arm shaft 121, rear control arm bearings 120, side arm spacer 158, ball joint 136 and the lift plate assembly 130 are forced downward by twice the rearward distance traveled by the cutting edge 112.

The bearings 120 provide a smoother reduced friction and load on the entire plow protection device 100. The control arm rear bearing shaft 121 is supported by right and left control side arms 128*a–b*, side arm spacer 158 and bolt/strut rod. The rear bearing shaft 121, side arms 128*a–b*, and spacer 158 are pivotable on control arm rod 134. The control arm rod 134 is mounted to the plow moldboard 106 with the use of bushings and control arm rod bolts, which are bolted through holes in the moldboard assembly 106. The control arm rod 134, right control arm 128*b*, and side stiffener 154 are welded together as one sub-assembly to the control arm assembly, which includes elements 120, 121, 128*a–b*, 134, 152, 154, and 158. The control arm assembly swings rotationally in an up and down motion with the control arm rod 134 as the pivot point.

Mounted to the center of the rear control arm shaft 121 by use of threads and locking nut is a ball joint 136. The ball end of the ball joint 136 is embedded into the lift plate assembly 130. The lift plate assembly 130 is comprised of a lift plate body 138, ball joint retainer 140, and lift plate wear protector 142. The ball joint retainer 140 holds the ball joint 136 and lift plate 138 together, allowing an orbital motion to the lift plate assembly 130. A lift plate forward tilt spring 600 is mounted, by use of a hole 602 in the lift plate forward tilt spring 600, to the stud portion of the ball joint 136. The extended portion of the lift plate forward tilt spring 600 applies pressure on the rear top edge of the lift plate body 138. The pressure the lift plate forward tilt spring 600 applies to the rear top edge of the lift plate body 138 assures that the lift plate body 138 does not tilt forward into a hole or void in the plowing surface 109 as the plow 101 is moving forward. Spring 600 is shown in isolation in FIG. 4K. The hole 602 is shown in a magnified view of a portion of the spring in FIG. 4L.

In one embodiment of the present invention, the lift plate wear protector 142 is a replaceable hardened steel disc constructed of a high speed stamping tool steel containing more than about 2% molybdenum (Mo) or more than about 5% tungsten excluding Tungsten carbide. The wear protector 142 is bolted through the lift plate body 138 and from ball joint retainer 140. The lift plate wear protector 142 prevents damage to the lift plate body 138 as it drags across the plowing surface 109 or impacts the ground obstacle 110. The orbital movement allows for side, front and rear impacts to the lift plate 138. This allows the lift plate 138 to lift, rotate, roll and tilt in reaction to the plowing surface contour and in the event the lift plate assembly is not retracted in time by the extension spring/struts 144 (shown in isolation in FIG. 4M) and as a result impacts the ground obstacle 110. The outer angle of the lift plate 138 allows the lift plate assembly 130 to climb the impacted obstacle 110 as the entire assembly 130 moves forward under the power of the plow vehicle.

The lift plate 138 is rear of the cutting edge 112. When an impact with the ground obstacle 110 occurs, the lift plate 138 becomes the new support for the plow's weight. The shift of location of the plow weight or resting point from the forward-most position of the cutting edge 112 to the lift plate 138 rear of the cutting edge 112 changes the distance of the plow's resting point to the plow's fixed fulcrum point 108.

This distance change multiplies the lifting action/distance by a factor of approximately 1.5 in the embodiment illustrated in FIG. 1A. For example, both multiplying factors in combination would cause a forward travel of 1" to yield an approximate lift of 3" at the location of the cutting edge 112. As soon as the cutting edge 112 clears the ground obstacle 110, the trip edge 113, the attached cutting edge 112, the control arm assembly, and the lift plate assembly 130 are instantaneously returned to their normal (untripped) position. This return is achieved under the spring load provided by extension spring/struts 144 and any springs on the plow's tripping device.

As mentioned above, the plow protection device 100 may be configured by the operator to begin lifting immediately upon impact of the plow blade edge 112 with the obstacle 110. This is adjusted by the threaded ball joint 136 and its lock nut within the rear bearing shaft 121 thread so that the lift plate wear protector 142 is in contact with the plowing surface 109 when the plow 101 is in its normal (untripped) position. Alternatively, the device 100 may be configured to begin lifting only after the tripping plow assembly or tripping edge 113 and cutting edge 112 have traveled a preset minimum distance. This is achieved by adjusting the threaded ball joint 136 and its lock nut within the rear bearing shaft 121 thread so that the lift plate wear protector 142 is held some distance above the plowing surface 109 when the plow 101 is in its normal (untripped) position. In such a case, impact of the trip edge 113 and cutting edge 112 with the obstacle 110 will cause the lift plate 142 to travel some distance downward before first making contact with the plowing surface 109 and lifting the edge 112 upward. The distance by which the lift plate assembly 130 is initially held off of the plowing surface 109 may be adjusted as desired.

Extension springs and struts 144 are mounted to the fixed pressure plates 122*a* and 122*b* at the top and to the moving control arm 128 at the bottom. The extension springs and struts 144 constantly apply pressure to pull the control arms 128*a–b* and lift plate assemblies 130 upward and to their normal position. The spring/strut 144 provides support so that if the assembly 130 passes over a hole in the ground the assembly 130 will not drop into the hole. Furthermore, once a ground obstacle is cleared and the plow assembly or trip edge 113 and cutting edge 112 returns to its normal position, the lift plate assembly 130 will be retracted by the extension springs 144, minimizing or eliminating any impact the lift plate assembly 130 would have with said ground obstacle. The entire mechanism 100 will instantaneously return to its normal position after it completes its work of lifting the cutting edge 112 off the impacted ground obstacle 110. Holes, which align through the right and left pressure plates 122*a–b* and the right and left control side arms 128*a–b*, are for a locking/shear pin 402 (FIG. 4B), which is held, retracted by a totally enclosed spring 406, backed with a miniature hydraulic cylinder 408, and utilizing the plow's existing hydraulic system. As described in more detail below with respect to FIGS. 4A–4J and FIG. 5, when the cylinder 408 is actuated, the locking/shear pin 402 is pushed through the holes to lock the plow protection device 100 and to prevent its movement. This may be done, for example, with a momentary push button switch 514 in the vehicle cab. One purpose of this feature is to prevent movement when scraping ice or packed snow at low speeds only.

Figure 3A:
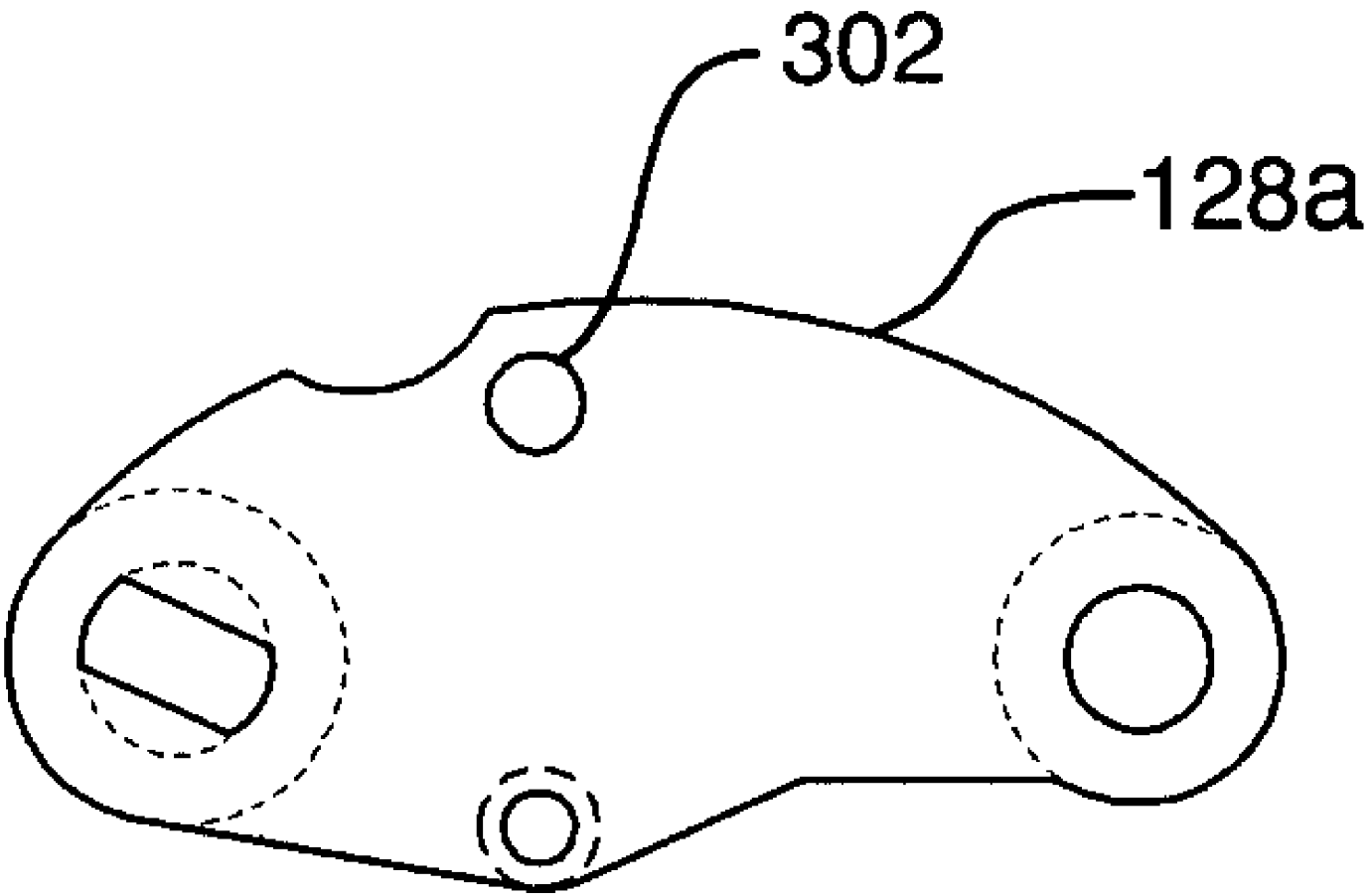
FIGS. 3A–G are views of various components of the plow protection device of FIG. 1A.
Figure 3C:
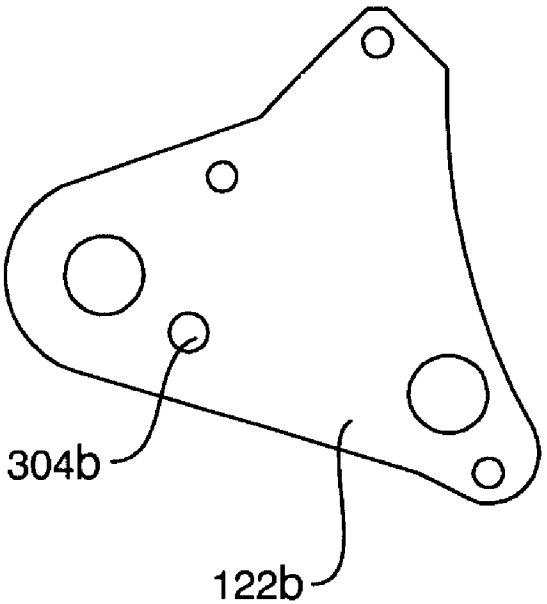
Figure 3B:
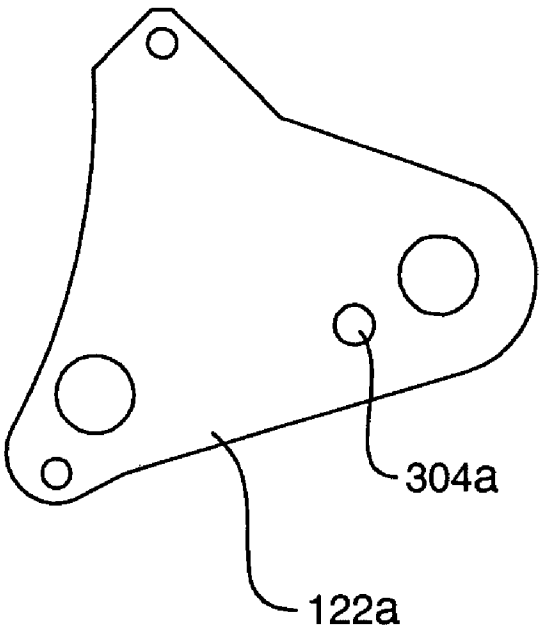
Figure 3E:
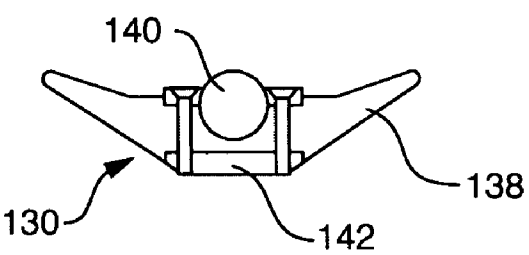
Figure 3G:
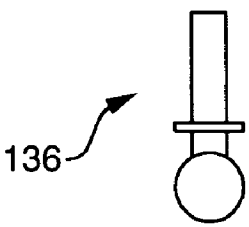
Figure 3D:
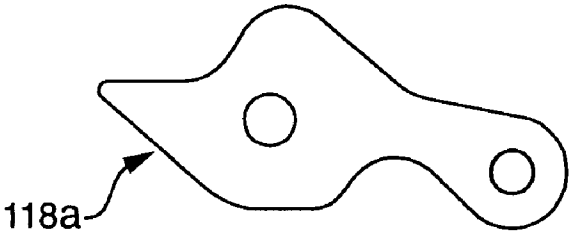
Figure 3F:
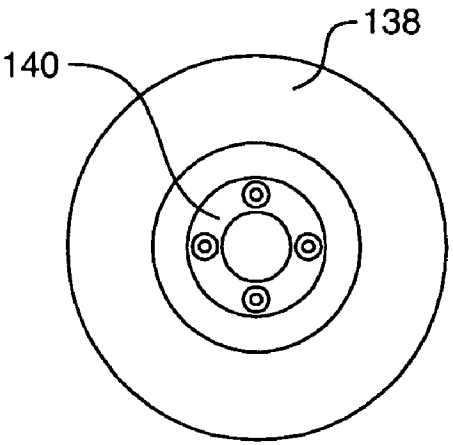

FIG. 3A is a side view of control arm 128*a* in isolation. Control arm 128*b* may be implemented in the same manner. FIGS. 3B and 3C are side views of the left and right pressure plates 122*a–b* in isolation. FIG. 3D is a side view of lift wedge 118*a* in isolation. Lift wedge 118*b* may be implemented in the same manner. FIG. 3E is a side view of the lift plate assembly 130 in isolation, and FIG. 3F is a top view of the lift plate assembly 130 in isolation. FIG. 3G is a side view of the ball joint 136 in isolation.

Referring to FIG. 1B, a side view of a plow protection device 170 according to another embodiment of the present invention is shown. The device 170 is similar to the device 100 shown in FIG. 1A, except that the device 170 in FIG. 1B is designed for use with a tripping (tilting) plow assembly for use in conjunction with a plow similar to a Curtis Snow-Pro 3000® snow plow. In the embodiment illustrated in FIG. 1B, the trip assembly, which includes the moldboard assembly 106 and cutting edge 112, pivots at the pivot point defined by pin 114. The plow shown in FIG. 1B includes extension spring 156 and pivoting U-frame 148.

Note that in the particular embodiment illustrated in FIG. 1B, the pressure plate angle 124 is not welded to the plow mold board assembly 106, thereby allowing the mold board assembly 106 to tilt forward and the pressure plates 122*a–b* to remain in place. Furthermore, the pressure plate bearing shaft 151 is fixed to the pivoting U-frame 148, thereby holding the shaft 151, bearings 150, and pressure plates 122*a–b* from floating. In this embodiment, the mold board assembly 106 tilts/pivots on the trip assembly pivot point 114.

As mentioned above, the plow protection device 100 may be equipped with a locking mechanism to remotely inhibit the lifting mechanism from activating. Such a locking mechanism may, for example, be advantageous for use in conjunction with low-speed freezing slush or frozen snow and ice removal.

Figure 4A:
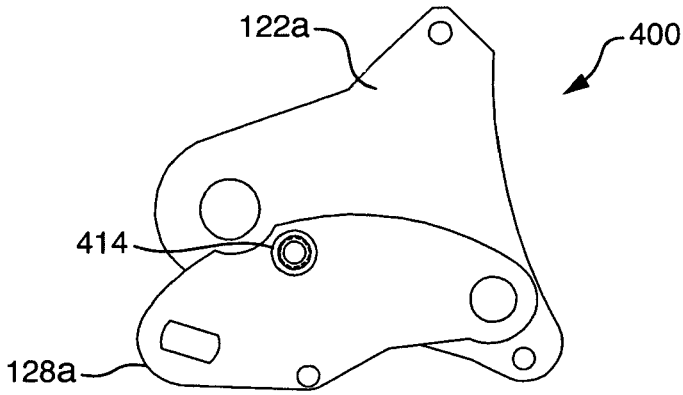
FIGS. 4A–4J are side views of a plow protection device locking mechanism, and components thereof, according to one embodiment of the present invention.
Figure 4B:
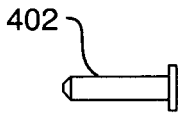
Figure 4C:
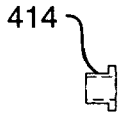

Referring to FIGS. 4A–4J, one embodiment of a locking mechanism 400 of the present invention is shown. In the illustrated embodiment, the locking mechanism 400 uses a hardened shear pin 402 that pushes through holes 302 in the control arm side plates 128*a–b* and into the pressure plates 122*a–b* through hardened bushing 414 in holes 304*a–b*. As shown in FIG. 4A, holes 302 and holes 304*a–b* are aligned with each other when the plow 101 is in its normal (untripped) position. This action of the pin 402 locks the movement of the control arms 128*a–b* and prohibits their lifting action. The locking mechanism 400 may be selectively activated to allow low speed frozen snow and ice removal without the tripping action of the plow 101 or trip edge 112.

Figure 4D:
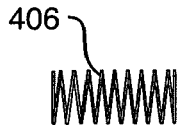
Figure 4E:
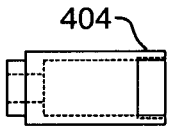
Figure 4F:
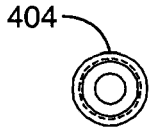
Figure 4G:
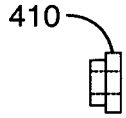
Figure 4H:
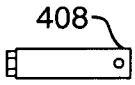
Figure 4I:
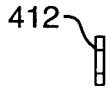
Figure 4J:
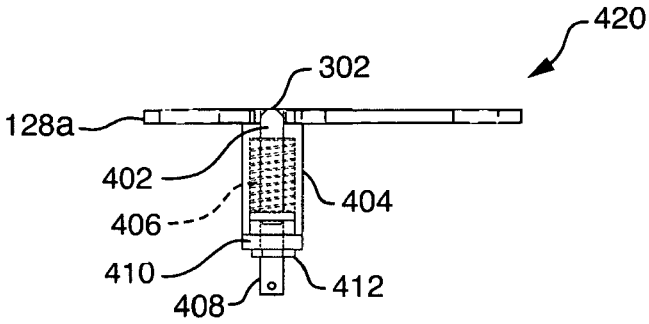
Figure 4K:
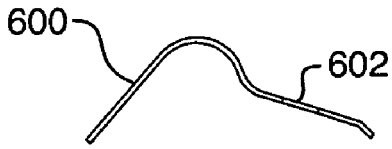
FIGS. 4K–4L are views of a lift plate forward tilt spring according to one embodiment of the present invention.
Figure 4L:
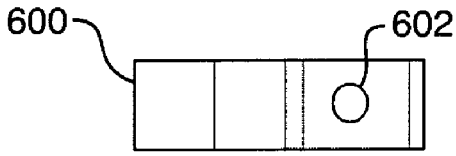
Figure 4M:
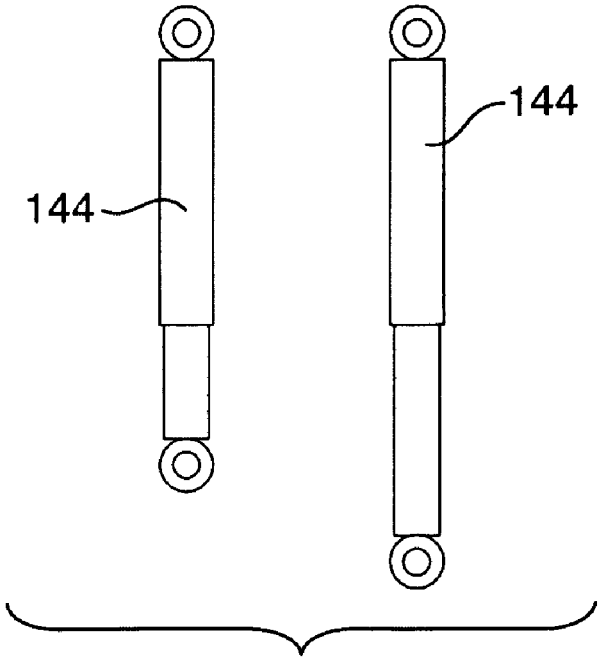
FIG. 4M is a side view of extension spring/struts according to one embodiment of the present invention.

The locking pin 402 is encased in a spring and pin chamber 404, shown in side view in FIG. 4E and in top view in FIG. 4J, which is threaded into each of the control arm side plates 128*a–b*. Referring to FIG. 4D, a compression spring 406 is shown, which holds the pin 402 in an unlocked retracted position. Referring to FIG. 4H, a miniature hydraulic cylinder 408 is shown which may be used to push the pin 402 toward the spring 406 and thereby to compress the spring 406. At full actuation the pin 402 enters the hardened bushings 414 in locking holes 304*a–b* in the pressure plates 122*a–b*, thereby prohibiting any movement of the control arms 128*a–b*. Hydraulic cylinder 408 threads into a cap and cylinder mount 410 (FIG. 4G) which threads into the pin and spring chamber 404 at its rear side, secured by a locking nut 412 (FIG. 4I).

Figure 5:
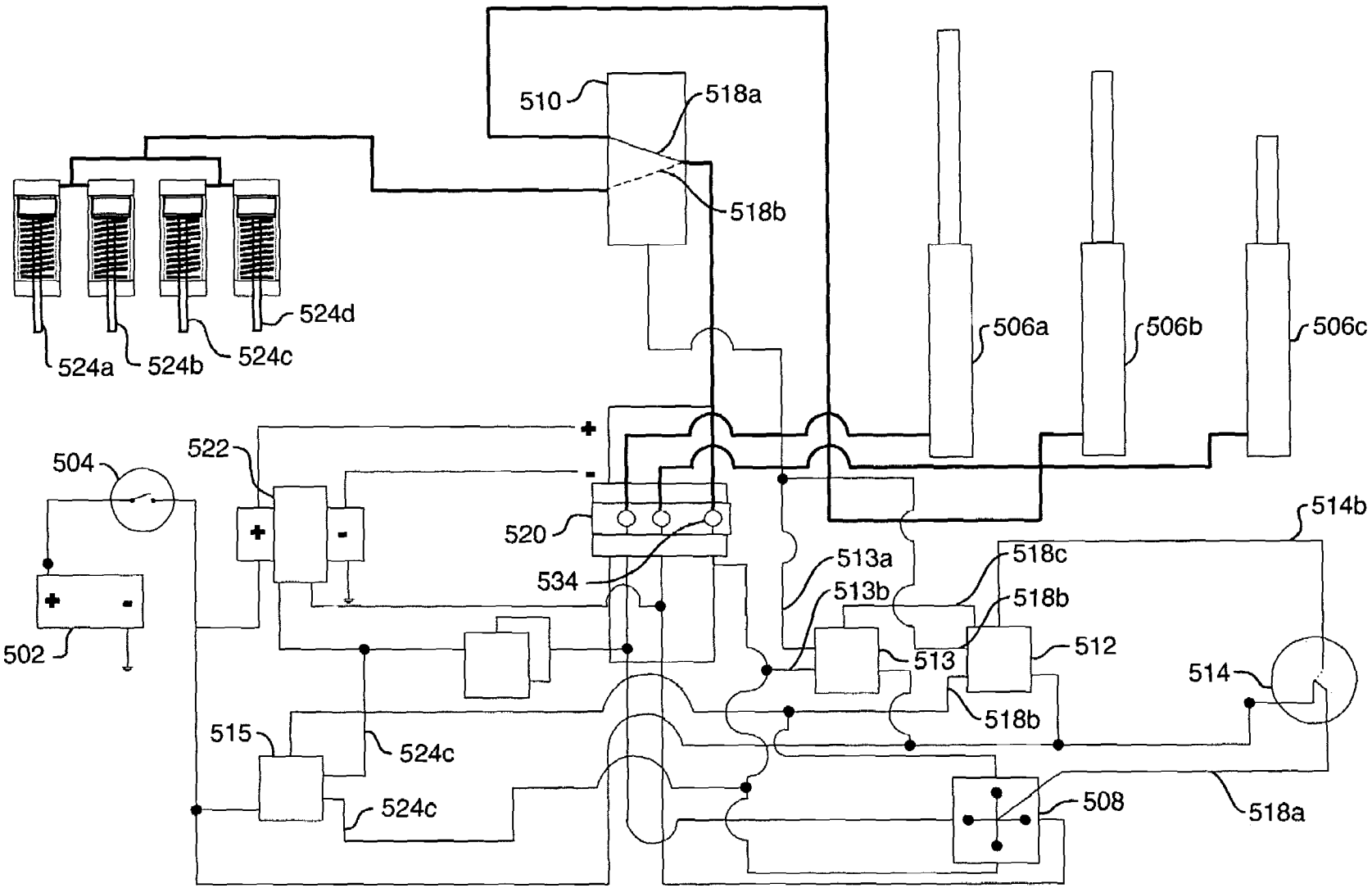
FIG. 5 is a schematic diagram of a system for controlling the locking mechanism of FIGS. 4A–4J according to one embodiment of the present invention.

Referring to FIG. 5, a schematic diagram is shown of a system 500 for controlling the locking mechanism 400 according to one embodiment of the present invention. In the embodiment illustrated in FIG. 5, the locking mechanism 400 is controlled by the plow's existing hydraulic system, with the addition of a 12 VDC actuated 3-way hydraulic valve 510, a solid state time delay relay 512, and a momentary push button switch 514 in the cab of the truck or other attached vehicle.

The truck or other vehicle includes a 12 VDC battery 502. Ignition switch 504 provides power from battery 502 to the remainder of the system 500. Under normal operation of the system 500, and as is well-known to those having ordinary skill in the art, a directional control stick 508 in the cab of the truck may be used to control the direction of movement of tilting and lifting cylinders 506*a–c* and thereby to control motion of the plow as desired by the plow operator. Movement of the cylinders 506*a–c* in response to movement of the control stick 508 is mediated by solid state relays 515 and 516, power relay 522 and pump control valves 532, 533 and 534.

Depressing the momentary push button 514 causes power from 12 VDC battery 502 to be diverted from the control switch 508 to activate solid state relay 512 through line 514*b*. The relay 512 has a release time-delay and switching function. Solid state relay 512 immediately outputs a control signal on output line 512*a*, which causes 3-way valve 510 to switch from default position 518*a* to locking position 518*b*. At the same time, solid state relay 512 outputs a signal on output line 512*b*, thereby activating an existing power solenoid 522 through the activation of solid state relay 515 by way of line 515*a*. Relay 515 also sends a signal through line 515*b* which opens the valve 534 on the pump 520. The signal on line 515*a* starts the plow's hydraulic pump assembly 520 by activating power solenoid 522. The new position 518*b* of the 3-way valve 510 diverts hydraulic fluid from the pump's reservoir to the miniature hydraulic cylinders 524*a–d*, thereby pushing in the locking pins, as described previously with respect to FIGS. 4A–4J.

When the momentary push button 514 is released, the solid state relay 512 cuts power to relay 515, which in turn cuts power to the power solenoid 522 and pump 520. Relay 512 then outputs a signal through line 512*c*. This holds the 3-way valve 510 in its diverted position and activates relay 513*a* for a short period of time, such as 3 seconds, thereby holding the valve 510 in a diverted position. At the same time, relay 513 sends a signal on line 513*b*, thereby holding valve 534 on the pump assembly open. During this 3-second time period the compressed spring energy in spring 406 retracts the locking pins 402, pushing the pistons in cylinders 524*a–d* to their normal position and therefore pushing the hydraulic fluid out of the locking cylinders 524*a–d* and back to the pump reservoir. After this delay, relay 512 drops its signal to relay 513 and the system and valve 510 is reset back to its default position 518*a*. In this way, the momentary push button 514 may be used to lock the plow protection device 100 in place when desired.

It is to be understood that although the invention has been described above in terms of particular embodiments, the foregoing embodiments are provided as illustrative only, and do not limit or define the scope of the invention. Various other embodiments, including but not limited to the following, are also within the scope of the claims. For example, elements and components described herein may be further divided into additional components or joined together to form fewer components for performing the same functions.

Furthermore, the particular components shown and described herein, such as the control arms 128*a–b*, lift wedge 118, and pressure plates 122*a–b*, may differ in geometry for each plow model. Although particular distance-to-lift ratios are described above, such ratios are merely examples, with more or less lift being attainable depending on changes in geometry and as may be required by the model of the plow to which the plow protection device is attached.

Alternative embodiments of the present invention may use various kinds of stored/restrained potential energy which is released at high velocities to lift the plow 101 and/or cutting edge 112 off the ground and off and away from the impacted ground obstacle 110. Such stored or restrained potential energy may, for example, be implemented using a compressed compression spring, a compressed gas charge, a extended extension spring, recoil springs, or controlled fuel combustion.

For example, in one alternative embodiment of the present invention, two heavy compression spring/struts are used to replace the extension spring struts 144. A resetting double-acting hydraulic cylinder is used to pre-load the compression spring struts, and a latch action is used to hold the springs compressed while the plow 101 is in normal operation. The hydraulic cylinder is mounted between the two springs and the pressure plates 122*a–b*, connected to the control arm 128 at the bottom and to the pressure plates 122*a–b* at the top, on the same rod as the spring struts.

When the cutting edge 112 impacts the ground obstacle 110, it moves rearward and the lift lever 116 hits the spring retaining latch. This releases the potential energy stored in the compressed springs, driving the control arm assembly into the plowing surface 109 and lifting the plow 101 and cutting edge 112 off the impacted ground obstacle 110. When the control arm 128 fully extends, a sensor at the bottom of the travel turns on the plow hydraulic pump and hydraulic fluid enters the bottom port of the cylinder. This re-compresses the springs and the latch action falls back into place, holding the springs in their pre-loaded position.

After a 3-second time delay, the pump valves redirect hydraulic pressure to the top port of the resetting hydraulic cylinder. This pushes just the cylinder piston down. All hydraulic fluid at the bottom side of the cylinder is allowed to flow back to the pump reservoir, and the cylinder rod stays in the up position. This holds the control arm 128 in the up position. The system is now reset and ready for another impact.

In yet another embodiment of the present invention, the lift wedges 118*a–b* and pressure plate bearing 150 shown in FIG. 1A are not used. In this embodiment, a single-acting high-pressure air cylinder is employed. The cylinder is pushed down with high-pressure compressed gas, stored in a compressed gas reservoir/cylinder. The extension spring struts hold the control arm 128 in the up position. The air cylinder is mounted between the two springs and pressure plates, connected to the lift wedge at the bottom and the pressure plates at the top. This is on the same rods as the spring struts.

When the cutting edge 112 impacts the ground obstacle 110, it moves rearward and the lift lever 116 enters the path of a sensor which releases the high-pressure gas into the top of the air cylinder. This potential energy forces the control arm assembly into the ground, thereby lifting the plow 101 and cutting edge 112 off of the impacted ground obstacle 110.

When the control arm 128 fully extends, a sensor at the bottom of the travel opens a quick-release air valve on the top of the air cylinder. The absence of pressurized air in the top of the air cylinder allows the extension spring struts to re-turn the control arm to the up position. The system is then ready for another impact.

Although the examples above are illustrated and described with respect to one or more particular kinds of plows, the techniques disclosed herein are not limited to application in conjunction with the particular plows and other features disclosed. Rather, the techniques disclosed herein are applicable to a variety of plows, including plows of all types that are fitted with a tripping mechanism or similar energy absorption devices. Such plows include but are not limited to vehicle power driven snow throwers, snow-removal plows and earth-grading plows. Examples of tripping mechanisms that may be used in conjunction with techniques disclosed herein include but are not limited to tripping edges and tripping plow assemblies.

Although certain embodiments of the present invention may be described above as being applicable to snow plowing, the techniques disclosed herein are not limited to snow plows. Rather, the techniques disclosed herein may be applied to any vehicle power driven equipment such as but not limited to vehicle mounted snow throwers and a wide variety of plows for use in any kind of plowing. Furthermore, although snow plows and other plows or vehicle power-driven equipment typically are mounted to the front and rear ends of light, medium, and heavy-duty trucks, front end loaders, back hoes, tractors, graders, and similar vehicles, the techniques disclosed herein may be applied to plows used in conjunction with any kind of vehicle and any kind of suitable energy absorption device or trip device.

Although a particular obstruction 110 is illustrated in FIGS. 1A–1F, the techniques disclosed herein are not limited to protecting against damage from any particular kind of obstruction. Rather, the techniques disclosed herein may be used to protect plows against damage from any impacting force, whether caused by an unexpected obstruction on the plowing surface (such as a rock or frozen tree branch), an unseen surface feature (such as a manhole cover, raised or cracked road sections or berms), or any other kind of obstruction.

Although the techniques disclosed herein may be used on paved roads, embodiments of the present invention are not limited thereto. Rather, the techniques disclosed herein may be applied to plows used on any kind of road surface, such as asphalt, cement, gravel, sand, or earth.

What is claimed is:

1. A device for use with a snow removal apparatus having a cutting edge, the device comprising:

lifting means, located rear of the cutting edge, for lifting the snow removal apparatus away from a snow removal surface and over an impacted obstacle by pressing down on the snow removal surface; and lift activation means, coupled to the lifting means, for activating the lifting means in response to an impact of a component of the snow removal apparatus with the obstacle.

2. The device of claim 1, wherein the snow removal apparatus comprises a plow.

3. The device of claim 2, wherein the impacted component of the snow removal apparatus comprises the cutting edge.

4. The device of claim 2, wherein the impacted component of the snow removal apparatus comprises a trip edge of the plow.

5. The device of claim 2, wherein the impacted component of the snow removal apparatus comprises a trip moldboard of the plow.

6. The device of claim 2, wherein the impacted component of the snow removal apparatus comprises an energy transference device.

7. The device of claim 1, further comprising force transference means operatively coupled to the lift activation means and to the impacted component of the snow removal apparatus for transferring force generated by impact of the impacted component with the obstacle to the lift activation means.

8. The device of claim 7, wherein the lifting means comprises means for redirecting the transferred force to the snow removal surface to lift the at least part of the snow removal apparatus away from the snow removal surface and over the impacted obstacle.

9. The device of claim 7, wherein the force transference means comprises:

a lift lever coupled to the impacted component of the snow removal apparatus.

10. The device of claim 9, wherein the lifting means comprises:

a lift wedge operatively coupled to the lift lever, whereby a movement of the lift lever in response to the transferred force creates a compatible movement of the lift wedge.

11. The device of claim 10, wherein the lifting means further comprises:

a lifting assembly;

a control arm assembly operatively coupled between a mounting component of the snow removal apparatus and the lifting assembly, the control arm assembly including a control arm bearing surface;

a pressure plate assembly coupled to the mounting component, the pressure plate assembly including a pressure plate bearing surface;

whereby movement of the lift lever in response to the transferred force applies force to the lift wedge, thereby providing a separating force between the control arm bearing surface and the pressure plate bearing surface, thereby pressing the lifting assembly towards the snow removal surface.

12. The device of claim 11, wherein the mounting component comprises a moldboard of the snow removal apparatus.

13. The device of claim 11, wherein the snow removal apparatus comprises a plow, and wherein the mounting component comprises a frame of the plow.

14. The device of claim 11, further comprising:

means for driving the lifting assembly and the control arm assembly away from the pressure plate bearing surface and toward the snow removal surface at a region of contact between the lifting assembly and the snow removal surface.

15. The device of claim 9, wherein the lifting means comprises:

a lever and cam assembly coupled to the lever coupled to the impacted component, whereby a movement of the lever in response to the transferred force creates a compatible movement of the lever and cam assembly.

16. The device of claim 15, wherein the lifting means further comprises:

a lifting assembly;

a control arm assembly coupled between a mounting component of the snow removal apparatus and the lifting assembly, the control arm assembly including a control arm bearing surface;

a pressure plate assembly coupled to the mounting component, the pressure plate assembly including a pressure plate bearing surface;

whereby movement of the lever in response to the transferred force applies force to the lever and cam assembly, thereby providing a separating force between the control arm bearing surface and the pressure plate bearing surface, thereby pressing the lifting assembly towards the snow removal surface.

17. The device of claim 1, wherein the lifting means comprises a lifting assembly comprising a lift plate body and a ball joint with an orbital coupling to the lift plate body.

18. The device of claim 17, wherein the lifting assembly further comprises a lift plate wear protector coupled to a surface of the lift plate body facing the snow removal surface.

19. The device of claim 18, wherein the lift plate wear protector is constructed of a material including more than about 2% molybdenum.

20. The device of claim 18, wherein the lift plate wear protector is constructed of a material including more than about 5% tungsten not including tungsten carbide.

21. The device of claim 17, wherein the lifting means comprises means for orbiting the lift plate body in response to impact of the lift plate assembly with an object.

22. The device of claim 21, wherein the object comprises the obstacle.

23. The device of claim 21, wherein the object comprises a feature of the snow removal surface.

24. The device of claim 1, wherein the lifting means comprises means for shortening a distance between a resting point of the snow removal apparatus on the snow removal surface and a mounting fulcrum point of the snow removal apparatus in response to impact of the component of the snow removal apparatus with the obstacle.

25. The device of claim 24, wherein the means for shortening comprises means for lifting the at least part of the snow removal apparatus away from the snow removal surface by a vertical distance greater than a lateral distance traveled by the snow removal apparatus over the snow removal surface within the duration of the impact.

26. The device of claim 1, wherein the lifting means comprises means for adjusting a default distance between a contact surface of the lifting means and the snow removal surface.

27. A device for use with a snow removal apparatus for removing snow from a snow removal surface, the snow removal apparatus having a cutting edge, the device comprising:

energy absorption means;

lifting means, located rear of the cutting edge, for lifting the snow removal apparatus away from the snow removal surface and over an impacted obstacle by pressing down on the snow removal surface; and lift activation means, coupled to the energy absorption means and the lifting means, for activating the lifting means in response to impact of the energy absorption means with the obstacle.

28. The device of claim 27, wherein the snow removal apparatus comprises a plow.

29. The device of claim 27, further comprising force transference means operatively coupled to the lift activation means and to the energy absorption means for transferring force generated by impact of the energy absorption means with the obstacle to the lift activation means.

30. The device of claim 29, wherein the lifting means comprises means for redirecting the transferred force to the snow removal surface to lift the snow removal apparatus away from the snow removal surface and over the impacted obstacle.

31. The device of claim 29, wherein the force transference means comprises:

a lift lever coupled to the impacted component of the snow removal apparatus.

32. The device of claim 31, wherein the lifting means comprises:

a lift wedge coupled to the lift lever, whereby a movement of the lift lever in response to the transferred force creates a compatible movement of the lift wedge.

33. The device of claim 32, wherein the lifting means further comprises:

a lifting assembly;

a control arm assembly operatively coupled between a mounting component of the snow removal apparatus and the lifting assembly, the control arm assembly including a control arm bearing surface;

a pressure plate assembly coupled to the mounting component, the pressure plate assembly including a pressure plate bearing surface;

whereby movement of the lift lever in response to the transferred force applies force to the lift wedge, thereby providing a separating force between the control arm bearing surface and the pressure plate bearing surface, thereby pressing the lifting assembly towards the snow removal surface.

34. The device of claim 33, wherein the mounting component comprises a moldboard of the snow removal apparatus.

35. The device of claim 33, wherein the snow removal apparatus comprises a plow, and wherein the mounting component comprises a frame of the plow.

36. The device of claim 33, further comprising:

means for driving the lifting assembly and the control arm assembly away from the pressure plate bearing surface and toward the snow removal surface at a region of contact between the lifting assembly and the snow removal surface.

37. The device of claim 31, wherein the lifting means comprises:

a lever and cam assembly coupled to the lever coupled to the energy absorption means, whereby a movement of the lever in response to the transferred force creates a compatible movement of the lever and cam assembly.

38. The device of claim 37, wherein the lifting means further comprises:

a lifting assembly;

a control arm assembly coupled between a mounting component of the snow removal apparatus and the lifting assembly, the control arm assembly including a control arm bearing surface;

a pressure plate assembly coupled to the mounting component, the pressure plate assembly including a pressure plate bearing surface;

whereby movement of the lever in response to the transferred force applies force to the lever and cam assembly, thereby providing a separating force between the control arm bearing surface and the pressure plate bearing surface, thereby pressing the lifting assembly towards the snow removal surface.

39. The device of claim 27, wherein the lifting means comprises a lifting assembly comprising a lift plate body and a ball joint with an orbital coupling to the lift plate body.

40. The device of claim 39, wherein the lifting assembly further comprises a lift plate wear protector coupled to a surface of the lift plate body facing the snow removal surface.

41. The device of claim 40, wherein the lift plate wear protector is constructed of a material including more than about 2% molybdenum.

42. The device of claim 39, wherein the lift plate wear protector is constructed of a material including more than about 2% tungsten not including tungsten carbide.

43. The device of claim 42, wherein the lifting means comprises means for orbiting the lift plate body in response to impact of the lift plate assembly with an object.

44. The device of claim 43, wherein the object comprises the obstacle.

45. The device of claim 43, wherein the object comprises a feature of the snow removal surface.

46. The device of claim 27, wherein the lifting means comprises means for shortening a distance between a resting point of the snow removal apparatus on the snow removal surface and a mounting fulcrum point of the snow removal apparatus in response to impact of the energy absorption means with the obstacle.

47. The device of claim 46, wherein the means for shortening comprises means for lifting the at least part of the snow removal apparatus away from the snow removal surface by a vertical distance greater than a lateral distance traveled by the snow removal apparatus over the snow removal surface within the duration of the impact.

48. The device of claim 27, wherein the lifting means comprises means for adjusting a default distance between a contact surface of the lifting means and the snow removal surface.

* * * * *